US005778585A

United States Patent [19]

Sigg

[11] Patent Number: 5,778,585

[45] Date of Patent: Jul. 14, 1998

[54] SEMIAUTOMATIC WEAPON

[75] Inventor: Hans-Peter Sigg, Altenburg/Jestetten, Germany

[73] Assignee: Schweizerische Industriegesellschaft, Switzerland

[21] Appl. No.: 702,476

[22] PCT Filed: Feb. 6, 1995

[86] PCT No.: PCT/EP95/00411

§ 371 Date: Sep. 30, 1996

§ 102(e) Date: Sep. 30, 1996

[87] PCT Pub. No.: WO95/23322

PCT Pub. Date: Aug. 31, 1995

[30] Foreign Application Priority Data

Feb. 26, 1994 [DE] Germany ..... 44 06 401.2
Apr. 8, 1994 [DE] Germany ..... 44 12 128.8

[51] Int. Cl.[6] ..... F41A 3/00

[52] U.S. Cl. ..... 42/69.03; 42/20; 89/147

[58] Field of Search ..... 42/69.03, 20; 89/147, 89/154

[56] References Cited

U.S. PATENT DOCUMENTS

| | | | |
|---|---|---|---|
| 1,568,005 | 12/1925 | Sutter | 42/69.03 |
| 2,522,194 | 9/1950 | Porter | 89/198 |
| 3,287,843 | 11/1966 | Seidel et al. | 42/69.03 |
| 3,949,508 | 4/1976 | Elkas | 42/69.03 |
| 4,361,072 | 11/1982 | Karlsen | 89/154 |
| 5,349,773 | 9/1994 | Sprangers | 42/42.02 |
| 5,417,001 | 5/1995 | Rousseau | 42/70.08 |
| 5,635,663 | 6/1997 | Krieger et al. | 89/142 |

FOREIGN PATENT DOCUMENTS

| | | |
|---|---|---|
| 0494439 | 7/1992 | European Pat. Off. . |
| 0634621 | 1/1995 | European Pat. Off. . |
| 2636728 | 3/1990 | France . |
| 4109777 | 10/1992 | Germany . |

*Primary Examiner*—J. Woodrow Eldred
*Attorney, Agent, or Firm*—Bachman & LaPointe, P.C.

[57] ABSTRACT

A semiautomatic weapon with a grip, a breech block and a hammer which is arranged rotatably about a hammer axis, wherein the position of the hammer axis relative to the grip can be varied.

13 Claims, 2 Drawing Sheets

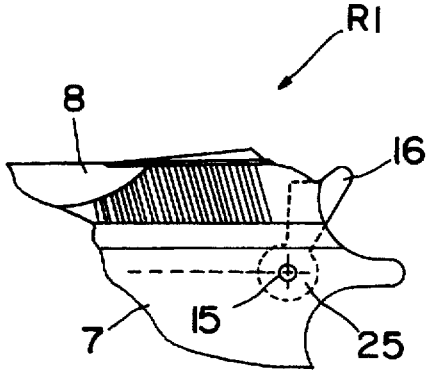
FIG.4
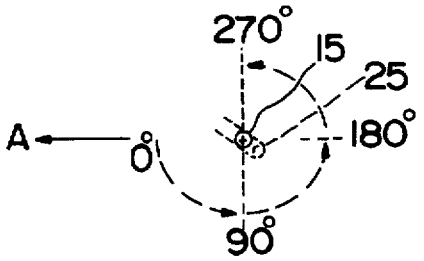
FIG.5
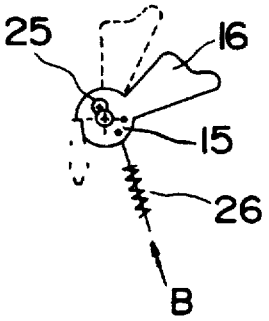
FIG.6
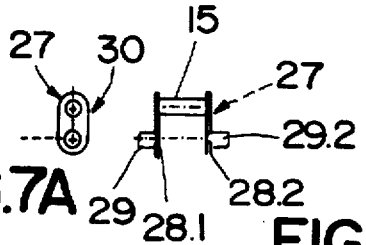
FIG.7A
FIG.7B

SEMIAUTOMATIC WEAPON

The invention relates to a semiautomatic weapon with a grip, a housing or the like, a breech block and a hammer which is arranged rotatably about a hammer axis.

Semiautomatic weapons are known and obtainable on the market in many forms and designs. They are distinguished in that, after the shot, an empty case of the cartridge is ejected as a result of the recoil and a new cartridge is inserted into the barrel, the hammer simultaneously being cocked as a result of a return of the breech block during ejection and reloading. Semiautomatic weapons of this type are used in all possible types of weapon, primarily in pistols and long-barrelled weapons. However, the invention is not restricted to these, but can be used in all semiautomatic weapons.

The semiautomatic weapons, in which projectiles accelerated by propellent gases are driven out of the barrel, generate recoil pulses which feel unpleasant and which are to be counteracted. Mention must be made primarily of two recoil pulses which, for example, make a pistol awkward to handle. These are, on the one hand, the firing pin cocking jolt and, on the other hand, the breech block impact jolt. Whereas the latter does not have such an adverse effect, since the projectile has already left the barrel, the firing pin cocking jolt, however, has a highly adverse effect on the accuracy of the shot. At the moment of the firing pin cocking jolt, the projectile is still located in the barrel, so that the pulse energy of the firing pin cocking jolt, said pulse energy being transmitted, for example, to the grip of a pistol, results in a deviation of the shot.

On the other hand, the recoil pulses which occur are not distributed uniformly in time, which precisely makes larger calibers difficult to control and, moreover, fatigues the firer.

Previous attempts to compensate this firing pin cocking jolt were restricted essentially to changes to the grip casing (Ruger) which, by means of a special mounting, are intended to make an elastic connection with the grip and thus damp the recoil.

In further tests, buffer elements, for example on the principle of the pneumatic spring, are used in the region of the closing spring, but the physical possibilities of these arrangements are greatly restricted purely and simply by low masses and therefore negligible energy absorption possibilities, so that, even when all the previous possibilities are utilized, a damping of the pulse peaks which occur is possible only in the ranges in which the projectile has already left the barrel. However, since the time between the firing of the shot and the exit of the projectile from the barrel is precisely the critical factor for the maximum attainable accuracy, but previous systems do not cover this range, known measures which have been executed are inadequate.

The object on which the present invention is based is to equalize the recoil pulse distribution as far as possible and, in particular, to counteract the firing pin cocking jolt pulse.

To achieve this object, the position of the firing pin axis relative to the grip and/or the position of the firing pin relative to its firing pin axis can be varied.

The essential feature of the present invention is that the firing pin can to a restricted extent shift aside from the returning breech block, so that the cocking of the firing pin is delayed, so that the projectile has already left the barrel when the cocking of the firing pin takes place. At the same time, the breech block no longer strikes the firing pin abruptly in order to cock it, so that the firing pin cocking jolt pulse is substantially minimized and equalized. The same also applies to the breech block impact jolt.

The total pulse occurring during the recoil is expanded in time and distributed uniformly. As long as the projectile has not yet left the muzzle, a very low pulse energy acts, for example, on the grip of a pistol. This makes extremely accurate firing possible.

Many possibilities are conceivable for taking sufficient account of the idea of the invention. Only preferred exemplary embodiments will be described below.

In an exemplary embodiment of the invention, an additional middle piece is arranged between the grip, the housing or the like and the breech block, this middle piece being displaceable relative to the grip and relative to the breech block counter to the firing direction. The movement of this middle piece is to be damped in any way. However, since the hammer axis is located in this middle piece, a damped compliance of this middle piece at the same time also brings about the desired delay of the firing pin cocking jolt and its equalization.

For example, the trigger guard, which, as is known, is of curved and spring-like design, could be considered as a damping element. If this trigger guard engages into a recess of the middle piece or is otherwise connected to the middle piece, the return force inherent in the trigger guard can be used for damping the movement of the middle piece.

However, the middle piece can also be supported relative to the grip via any force accumulators. Simple helical springs, but also other damping elements, could be considered as force accumulators.

If desired, the middle piece can also be of multipart design, the individual parts being supported relative to one another via damping elements, especially springs.

Preferably, the middle pieces, grips and breech block are coupled to one another by means of corresponding rail elements, so that the relative movement of the individual elements in or counter to the firing direction remains possible.

In another exemplary embodiment of the invention, the idea is to mount the hammer axis in a long hole, the hammer axis being displaceable in this long hole counter to a return element. Conversely to this, the hammer has a bearing bore, into which a fixed hammer axis engages, the bearing bore being designed as a long hole.

Both embodiments are equivalent and afford results which have the same effect.

So that the hammer axis is displaceable in the long hole, this long hole is to be arranged in a direction which runs at approximately 90° to 270° relative to the firing direction. During the return of the breech block, therefore, a displacement of the hammer axis relative to the breach block takes place.

When the breech block returns to its initial position again, the hammer axis or the firing pin is also to follow this movement. For this purpose, separate return elements can be provided. However, it is also expedient to use, here, the already existing hammer cocking spring for cocking the hammer.

In addition to the possibilities just mentioned, it is also conceivable for the hammer axis to be mounted in a separate trigger housing. This can then, in turn, be arranged displaceably or in any way movably in the grip, the housing or the like. Many possibilities are conceivable here and are covered by the present invention.

An exemplary embodiment which is also to be particularly described is the eccentric arrangement of the hammer axis. This means that, during the return of the breech block, the hammer axis rotates about a fixed point, a variation in the position of the hammer taking place simultaneously. For the sake of simplicity, in this exemplary embodiment, the hammer axis can be arranged on a crank which is then, in turn, assigned return elements for rotating it back into an initial position.

On account of the above-mentioned measures, a uniform distribution over time of the recoil pulses which occur and an expansion of the active pulse time are obtained, thus affording considerable relief to the firer. Furthermore, the invention makes it possible to use ammunition of substantially higher momentum, the use of which was greatly restricted, especially in previous hand weapons, by the natural stress limits of the firer and of the weapon.

However, the essential advantage of the invention is the displacement of the pulse maximum to a moment when the projectile has already left the barrel, thus resulting in a considerable increase in the accuracy of the shot.

Further advantages in terms of construction and production arise, since the grip can be produced as a plastic injection molding, thus resulting in a reduction in the production costs and weapon weight.

Further advantages, features and details of the invention emerge from the following description of preferred exemplary embodiments and with reference to the drawing in which FIG. 1 shows a force/time diagram for semiautomatic weapons;

FIG. 4 shows a detail of a further exemplary embodiment of a semiautomatic weapon according to the invention;

FIG. 5 shows a diagrammatic representation of the arrangement of a guide for a hammer;

FIG. 6 shows a diagrammatic top view of a hammer with an associated hammer spring;

FIGS. 7A and 7B show a side view and a front view, respectively, of an eccentric hammer axis according to the invention.

Figure 1:
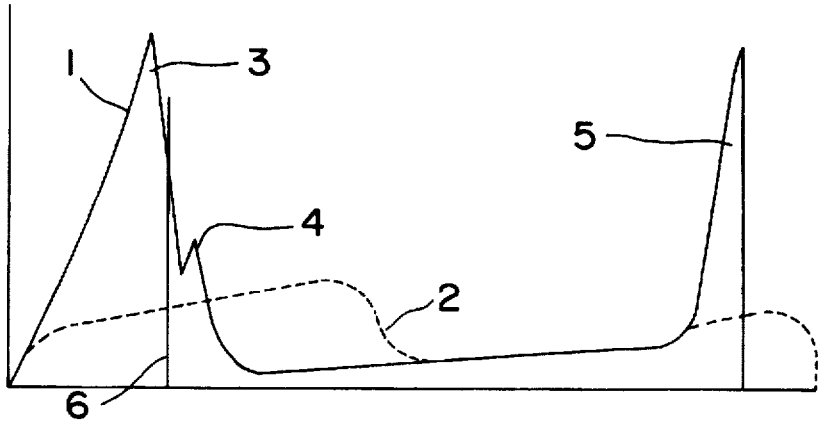

According to FIG. 1, an unbroken line 1 represents a force/time diagram 1 for a conventional semiautomatic weapon without damping. The broken line 2 shows a force/time diagram 2 for a semiautomatic weapon according to the invention with damping.

All weapons, in which projectiles accelerated by propellant gases are driven out of a barrel, generate recoil pulses which are dependent on the mass of the weapon, the mass of the projectile, the mass of the propellant charge and the projectile velocity achieved. These recoil pulses are clearly recognizable from the peaks in the line 1.

They relate, on the one hand, to a hammer cocking jolt 3 which occurs when a breech block strikes the hammer. This is followed, in recoil-operated guns with a short barrel return, by a barrel release jolt 4. The last pulse peak constitutes a breech block impact jolt 5 caused by an impact of the breech block at the point of its maximum possible return.

The vertical line 6 indicates the moment when the projectile leaves the muzzle of the semiautomatic weapon. This moment is between the firing pin cocking jolt 3 and the barrel release jolt 4, so that the hammer cocking jolt 3 is transmitted to a grip, housing or the like at a moment when the projectile has not yet left the barrel.

Figure 2:
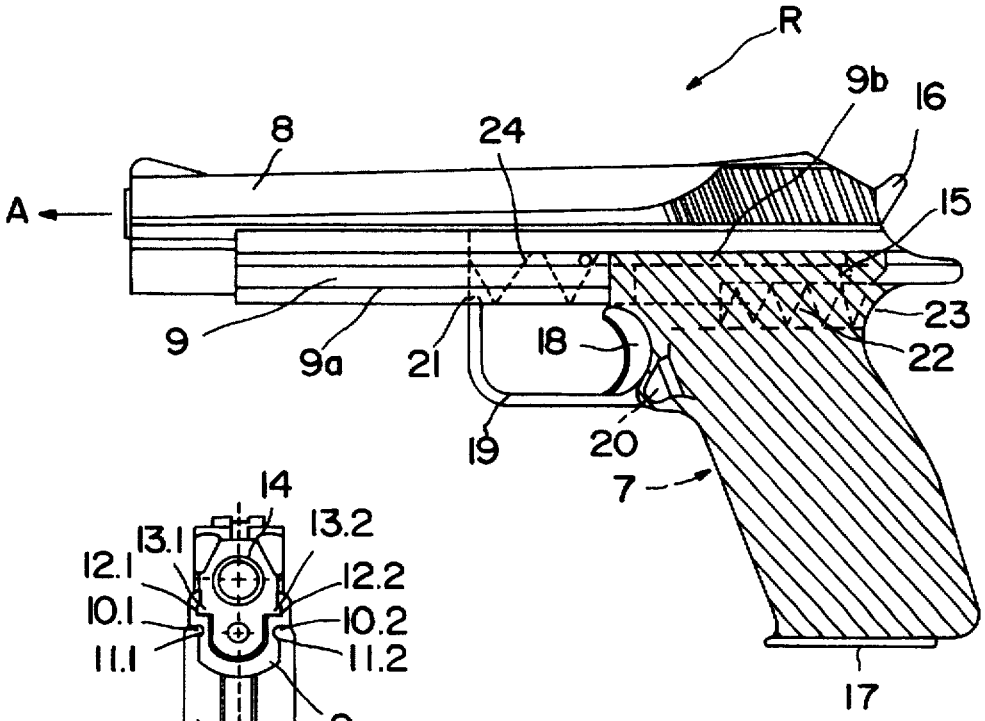
FIG. 2 shows a side view of a semiautomatic weapon according to the invention.
Figure 3:
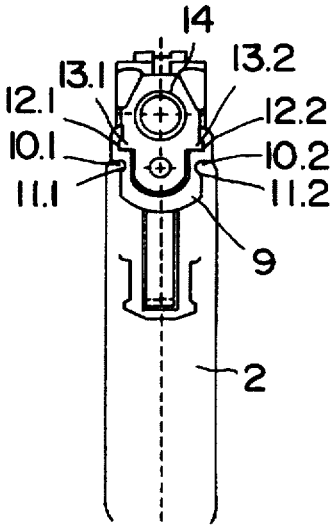
FIG. 3 shows a front view of the semiautomatic weapon according to FIG. 2.

In a first exemplary embodiment of the invention according to FIGS. 2 and 3, a middle piece 9 is inserted in a semiautomatic weapon R between a grip 7 and the breech block 8. This middle piece 9 is guided relative to the grip 7 by rails 10.1 and 10.2, these rails 10.1 and 10.2 being of clip-like design and engaging into corresponding guide grooves 11.1 and 11.2 on the middle piece 9. The middle piece 9 is thereby mounted displaceably relative to the grip 7 counter to the firing direction A. Other axial guides are also known and conceivable and come with the scope of the present invention.

The middle piece 9 forms, in turn, guide grooves 12.1 and 12.2, into which strips 13.1 and 13.2 on the breech block 8 engage, so that the breech block 8, in turn, is mounted displaceably relative to the middle piece 9 in the axial direction A.

Located in the breech block 8 are a barrel 14, removable if appropriate, and a known return spring, not shown in any more detail, for the breech block.

Furthermore, FIG. 2 indicates a hammer axis at 15 and a hammer at 16. The hammer axis 15 is located in the middle piece 9, so that said hammer axis and, together with it, the hammer 16 can shift aside to the rear counter to the firing direction A.

A magazine 17 can also be seen in the grip 7. Furthermore, a trigger 18 is surrounded by a trigger guard 19. In the present exemplary embodiment this trigger guard axis is connected to the grip 7 via a pivot 20. At the same time, the trigger guard 19 can be fixed in a desired locking position in a way not shown in any more detail.

In the locking position, the trigger guard 19 engages with a free end into a recess 21 in the middle piece 9 and forms a resilient abutment against a return of the middle piece 9 counter to the firing direction A. However, this is only one conceivable possibility which the present invention is to include. However, all other possibilities for springing the return of the middle piece 9 come within the scope of the invention. In the present exemplary embodiment, two further possibilities are also indicated.

In the first of the other possibilities, the middle piece 9 is supported via a spring 22 inside the grip 7 against a stop 23. However, a resilient support of this type can also be provided at any other point of the middle piece 9.

A further possibility is to design the middle piece in two parts. In this case, a front middle piece part 9*a* is supported via a further spring 24 against a rear middle piece part 9*b*, the axis for the hammer 16 also being arranged in this rear middle piece part 9*b*.

In a further exemplary embodiment of the semiautomatic weapon R1 according to FIGS. 4 to 7, the hammer 16 is arranged in such a way that it can to a limited extent shift aside from a hammer cocking jolt of the breech block 8. In this case, according to the invention, the hammer axis 15 is mounted in a long hole 25 in the grip 7. This long hole 25 insures that the hammer axis 15 can shift aside to the rear, specifically, according to FIG. 5, within a range of 90° to 270° in relation to the firing direction A, preferably at an angle of 100° to 260°.

If the long hole 25 is arranged at an angle of between 90° and 180°, there is no need for an additional element for returning this hammer axis 15 into the initial position, since this return is performed by a hammer spring 26 itself which acts on the hammer 16 in a known way in the force direction B according to FIG. 6. After the cocking of the hammer 16, the hammer spring 26, also causes the hammer to be driven forward towards the detonating element of the cartridge. Moreover, FIG. 6 indicates the hammer 16 in its cocking position and, by a broken line, in the uncocked position.

Instead of displacement in a long hole, an eccentric mounting of the hammer axis according to FIGS. 7A and 7B in a crank 27 is also conceivable. In this case, as shown in FIG. 7A, two tabs 28.1 and 28.2 are fastened laterally to the hammer axis 15 and hold the hammer axis 15 between them at one end. At the other end, they have bearing journals 29.1 and 29.2 which engage into corresponding recesses in the grip 7. As soon as the breech block runs back, the hammer 16 shifts aside as a result of the rotation of the crank 27, as represented by the arrow 30 in FIG. 7B. A return takes place via corresponding return elements not shown in any more detail, such as, for example, a spring.

It can be seen clearly in FIG. 1, from the line 2 representing the force/time diagram of a semiautomatic weapon according to the invention, that the recoil pulses and especially the hammer cocking jolt pulse are damped quite substantially. This is a very important advantage of the present invention.

I claim:

1. A semiautomatic weapon with a grip, a breech block and a hammer which is arranged rotatably about a hammer axis, and means for varying the position of the hammer axis relative to the grip so that the hammer axis is displaceable relative to the breech block.

2. A semiautomatic weapon with a grip, a breech block and a hammer which is arranged rotatably about a hammer axis, including means for varying the position of the hammer axis relative to the grip and the position of the hammer relative to its hammer axis so that the hammer axis is displaceable relative to the breech block.

3. A semiautomatic weapon with a grip, a breech block and a hammer which is arranged rotatably about a hammer axis, wherein the hammer axis is mounted in a long hole, the position of the hammer relative to its hammer axis in said long hole being variable, wherein the long hole runs at an angle of 90° to 270° counter to the firing direction (A).

4. The semiautomatic weapon as claimed in claim 1, wherein the hammer axis is arranged in a middle piece between the grip, and the breech block, the middle piece being displaceable relative to the grip and relative to the breech block counter to a firing direction.

5. The semiautomatic weapon as claimed in claim 4, wherein the movement of said middle piece counter to the firing direction (A) is damped.

6. The semiautomatic weapon as claimed in claim 5, wherein a trigger guard engages into a recess in the middle piece.

7. The semiautomatic weapon as claimed in claim 5, wherein the middle piece is supported relative to the grip via a force accumulator.

8. The semiautomatic weapon as claimed in claim 5, wherein the middle piece consists of at least two middle piece parts which are supported relative to one another via force accumulators.

9. The semiautomatic weapon as claimed in claim 5, wherein the middle piece is guided in the grip and the breech block is guided relative to the middle piece axially.

10. The semiautomatic weapon as claimed in claim 3, wherein a return element is assigned to one of the hammer and the hammer axis.

11. The semiautomatic weapon as claimed in claim 10, wherein the return element is a hammer spring.

12. The semiautomatic weapon as claimed in claim 1, wherein the hammer axis is mounted in a trigger housing and the latter is mounted displaceably in the grip.

13. The semiautomatic weapon as claimed in claim 1, wherein the hammer axis is displaceable in a direction counter to the firing direction.

* * * * *